US011078683B2

(12) United States Patent
Harrison

(10) Patent No.: US 11,078,683 B2
(45) Date of Patent: Aug. 3, 2021

(54) LOCKABLE LATCH HANDLE ASSEMBLY

(71) Applicant: WERNER CO., Greenville, PA (US)

(72) Inventor: Craig Harrison, Gulf Breeze, FL (US)

(73) Assignee: WERNER CO., Greenville, PA (US)

( * ) Notice: Subject to any disclaimer, the term of this patent is extended or adjusted under 35 U.S.C. 154(b) by 265 days.

(21) Appl. No.: 16/293,915

(22) Filed: Mar. 6, 2019

(65) Prior Publication Data

US 2019/0234106 A1 Aug. 1, 2019

Related U.S. Application Data

(63) Continuation-in-part of application No. 15/882,155, filed on Jan. 29, 2018.

(51) Int. Cl.

| | |
|---|---|
| ***E05B 13/00*** | (2006.01) |
| ***E05B 65/52*** | (2006.01) |
| ***E05B 67/38*** | (2006.01) |
| ***E05C 3/22*** | (2006.01) |

(52) U.S. Cl.

CPC ..... *E05B 13/004* (2013.01); *E05B 13/002* (2013.01); *E05B 65/5238* (2013.01); *E05B 65/5284* (2013.01); *E05B 67/383* (2013.01); *E05C 3/22* (2013.01); *Y10T 292/0821* (2015.04); *Y10T 292/0845* (2015.04); *Y10T 292/0851* (2015.04); *Y10T 292/0859* (2015.04); *Y10T 292/0863* (2015.04); *Y10T 292/0954* (2015.04); *Y10T 292/108* (2015.04); *Y10T 292/1025* (2015.04); *Y10T 292/1028* (2015.04); *Y10T 292/1043* (2015.04); *Y10T 292/1075* (2015.04); *Y10T 292/1076* (2015.04); *Y10T 292/1077* (2015.04)

(58) Field of Classification Search

CPC ..... Y10T 292/1028; Y10T 292/0851; Y10T 292/0821; Y10T 292/1043; Y10T 292/1075; Y10T 292/1076; Y10T 292/1077; Y10T 292/108; Y10T 70/5558; Y10T 70/5544; Y10T 292/0845; Y10T 292/0846; Y10T 292/0859; Y10T 292/086; Y10T 292/0863; Y10T 292/0995; Y10T 292/0954; Y10T 292/1022; Y10T 292/1025; Y10T 292/106; Y10T 292/1086; Y10T 292/57; E05B 65/5284; E05B 65/52; E05B 65/523; E05B 59/00; E05B 67/383; E05B 13/004; E05B 13/002; B60R 9/00; E05C 3/22

USPC ..... 70/15–159, 162, 344

See application file for complete search history.

(56) References Cited

U.S. PATENT DOCUMENTS 928,904 A * 7/1909 Cottrell ..... E05B 65/5238 70/71

1,169,965 A * 2/1916 Kellogg ..... B60R 25/005 70/200

1,789,775 A * 1/1931 Russ ..... E05C 3/24 70/485

(Continued)

*Primary Examiner* — Kristina R Fulton

*Assistant Examiner* — Faria F Ahmad

(74) *Attorney, Agent, or Firm* — McDonnell Boehnen Hulbert & Berghoff LLP

(57) ABSTRACT

A lockable latch handle assembly for enclosures such as truck tool boxes comprises the combination of a key cylinder, and a latch handle that may be secured by a padlock to the front wall of the box, to collectively prevent opening of latches that secure the lid of the box in a closed position.

6 Claims, 6 Drawing Sheets

(56) References Cited

U.S. PATENT DOCUMENTS 1,829,601 A * 10/1931 Mears ..... E05B 83/247 292/215
2,198,079 A * 4/1940 Ferris ..... E05B 67/383 292/143
2,455,772 A * 12/1948 Jackle ..... E05B 65/0007 292/88
2,468,575 A * 4/1949 Sweaney ..... E05C 19/08 292/205
2,482,341 A * 9/1949 Holmsten ..... E05C 1/04 292/148
2,525,642 A * 10/1950 Bradshaw ..... E05C 17/44 292/178
2,536,352 A * 1/1951 Butcher ..... E05B 67/383 292/148
3,572,062 A * 3/1971 Beebe ..... E05B 67/38 70/1.5
3,727,438 A * 4/1973 Knaack ..... E05B 67/38 70/63
3,843,173 A * 10/1974 Harrell ..... E05B 13/002 292/7
3,851,942 A * 12/1974 Clay ..... E05C 19/18 312/333
3,953,062 A * 4/1976 Maston ..... E05B 67/38 292/57
4,273,368 A * 6/1981 Tanaka ..... E05B 83/16 292/48
4,290,281 A * 9/1981 Knaack ..... E05B 67/38 70/159
4,307,904 A * 12/1981 Daus ..... E05B 67/38 292/148
4,350,032 A * 9/1982 Kochackis ..... E05B 17/142 70/159
4,369,993 A * 1/1983 Rodriguez ..... E05B 67/383 292/148
4,437,692 A * 3/1984 Halopoff ..... E05B 67/38 292/57
4,573,722 A * 3/1986 Lyng ..... E05B 67/383 292/148
4,580,818 A * 4/1986 Lyng ..... E05B 67/383 292/148
4,615,548 A * 10/1986 McGee ..... E05B 47/0002 292/144
4,655,487 A * 4/1987 Korn ..... E05C 1/04 292/57
4,741,564 A * 5/1988 Alford ..... E05C 19/08 292/205
4,768,816 A * 9/1988 Bakula ..... E05B 83/10 292/218
4,782,675 A * 11/1988 Thorburn ..... E05B 35/12 292/148
4,852,920 A * 8/1989 DeForrest, Sr. ..... E05B 67/38 292/205
4,884,421 A * 12/1989 Lindsay ..... E05B 67/383 70/129
4,895,007 A * 1/1990 Eberly ..... E05B 67/38 292/104
4,896,518 A * 1/1990 Appelgren ..... E05B 67/38 70/14
4,911,486 A * 3/1990 Anderson ..... E05B 67/38 292/148
4,978,816 A * 12/1990 Castonguay ..... H01H 9/282 200/43.14
4,986,578 A * 1/1991 Hall ..... E05B 63/20 292/104
4,998,425 A * 3/1991 Hoogland ..... B60R 9/00 224/315
5,000,494 A * 3/1991 Guibleo ..... E05C 1/04 292/148
5,016,928 A * 5/1991 Segovia ..... E05B 65/0007 292/205
5,085,341 A * 2/1992 Hodge ..... B65F 1/1615 220/811
5,092,143 A * 3/1992 Rumbles ..... E05B 67/38 292/205
5,149,153 A * 9/1992 Drewry ..... B65F 1/1615 220/908
5,150,591 A * 9/1992 Norden, Jr. ..... E05C 7/04 292/148
5,226,302 A * 7/1993 Anderson ..... E05B 15/022 292/341.18
5,235,830 A * 8/1993 Benge ..... E05B 63/244 292/148
5,257,839 A * 11/1993 Nielsen ..... E05C 19/14 292/104
5,261,258 A * 11/1993 Bunger ..... E05B 67/38 292/148
5,307,653 A * 5/1994 Davis ..... E05B 67/38 292/148
5,308,126 A * 5/1994 Weger, Jr. ..... E05C 3/162 292/48
5,419,598 A * 5/1995 Kreitzer ..... B65F 1/1615 292/205
5,518,281 A * 5/1996 Steward ..... E05B 67/383 292/145
5,601,206 A * 2/1997 Haas ..... B60R 9/00 16/254
5,692,401 A * 12/1997 Khalsa ..... E05B 13/001 292/DIG. 32
5,711,555 A * 1/1998 Leedy ..... E05C 19/184 292/202
5,737,946 A * 4/1998 Sole ..... E05B 13/001 292/104
5,743,118 A * 4/1998 Anderson ..... E05B 13/002 292/205
5,875,948 A * 3/1999 Sadler ..... B60R 9/00 220/210
5,924,616 A * 7/1999 Shives ..... B60R 11/06 224/281
5,967,392 A * 10/1999 Niemi ..... B60R 9/00 16/289
6,000,250 A * 12/1999 Daoud ..... E05B 67/383 292/28
6,006,556 A * 12/1999 Daoud ..... E05B 37/20 292/251.5
6,047,573 A * 4/2000 Martinez ..... E05B 67/383 220/367.1
6,058,748 A * 5/2000 Beals, Jr. ..... E05B 13/002 292/104
6,068,308 A * 5/2000 Molzer ..... E05B 13/10 292/336.3
6,182,479 B1 * 2/2001 Daoud ..... E05B 63/0043 292/285
6,334,560 B1 * 1/2002 Lentini ..... B60R 9/00 220/244
6,349,577 B1 * 2/2002 Hansen ..... E05B 5/00 292/DIG. 31
6,351,975 B1 * 3/2002 Valdes ..... E05B 67/38 292/148
6,386,409 B1 * 5/2002 Cheney ..... B60R 9/00 220/525
6,454,320 B1 * 9/2002 Weinerman ..... E05B 13/105 290/53
6,494,064 B1 * 12/2002 Pena ..... E05B 67/38 292/148
6,502,868 B1 * 1/2003 Laspa ..... B25H 3/02 292/11
6,540,268 B2 * 4/2003 Pauser ..... A45C 13/06 220/243
6,772,613 B2 * 8/2004 Webb ..... B25H 3/02 292/148
6,823,701 B1 * 11/2004 Gogel ..... E05B 13/001 292/148
6,857,298 B2 * 2/2005 Linares ..... E05B 63/143 292/DIG. 37
6,959,846 B2 * 11/2005 Schomaker ..... B60P 3/075 220/324
6,962,375 B2 * 11/2005 Linares ..... E05C 3/24 292/201

(56) References Cited

U.S. PATENT DOCUMENTS 7,131,300 B1 * 11/2006 Monasco ..... E05B 13/001 70/55
7,278,284 B1 * 10/2007 James ..... E05B 13/002 292/205
7,360,817 B2 * 4/2008 Schwalie ..... B60R 9/00 174/153 G
7,454,933 B1 * 11/2008 Paige ..... E05B 1/0092 292/207
8,096,152 B2 * 1/2012 Wagh ..... E05C 9/02 70/56
8,342,580 B2 * 1/2013 Cowie ..... E05B 65/5238 292/32
8,347,667 B2 * 1/2013 Bacon ..... E05B 59/00 70/107
8,438,884 B1 * 5/2013 Bertrand ..... E05B 67/38 70/54
9,151,078 B2 * 10/2015 Lackey ..... B60R 9/065
9,260,890 B2 * 2/2016 Harrison ..... E05C 3/12
9,272,820 B2 * 3/2016 Cowie ..... B25H 3/02
9,297,183 B2 * 3/2016 Williams ..... E05B 15/024
9,314,919 B2 * 4/2016 Harrison ..... B65D 51/24
9,469,181 B2 * 10/2016 Jeffries ..... B65D 43/22
9,663,278 B1 * 5/2017 Daws, II ..... E05B 63/244
10,081,467 B2 * 9/2018 Daws, II ..... E05B 65/5276
10,337,220 B2 * 7/2019 Bowles ..... E05B 67/383
2002/0108410 A1 * 8/2002 Webb ..... B25H 3/02 70/159
2002/0112511 A1 * 8/2002 Molzer ..... E05B 1/0092 70/208
2002/0148259 A1 * 10/2002 Finkelstein ..... E05B 65/0053 70/92
2004/0055344 A1 * 3/2004 Bullock ..... E05B 13/002 70/212
2004/0123636 A1 * 7/2004 Linares ..... E05B 63/143 70/159
2006/0201210 A1 * 9/2006 Gogel ..... E05B 67/38 70/56
2006/0230794 A1 * 10/2006 Liu ..... E05B 13/103 70/63
2007/0240462 A1 * 10/2007 James ..... E05B 67/383 70/159
2011/0252838 A1 * 10/2011 Stuckey ..... E05B 13/002 70/20
2014/0130722 A1 * 5/2014 Dudgeon ..... E05G 1/08 109/53

* cited by examiner

LOCKABLE LATCH HANDLE ASSEMBLY

FIELD OF THE INVENTION

This invention relates to latch handle assemblies for enclosures, and, more particularly, to an assembly in which a latch handle for actuating a latch may be locked by a key cylinder and a padlock to provide an added degree of protection from unwanted opening of the enclosure.

BACKGROUND OF THE INVENTION

Latches are routinely used on chests, cabinets, tool boxes and other containers or enclosures where a lid or door must be retained in a closed and locked position. Typically, latches include a latch plate moveable between a latched position and an unlatched position. When unlatched, the latch plate may receive a striker pin mounted to the lid of a toolbox, for example, as the lid is moved to a closed position. Once the lid is closed, the latch plate moves to the latched position to capture the striker pin and retain the lid in the closed position.

Truck tool boxes and other enclosures having a relatively long length dimension typically include two or more latches spaced along the lid and the front wall of the enclosure to ensure that the lid is securely held in place when in the closed position. When two latches are employed, for example, one or both may be provided with a latch handle which can be actuated to move a first one of the latches to an unlatched position in which the striker pin is released thus allowing the lid to open. In many enclosure designs, an operating rod is extended between the latches which is effective to actuate the second one of the latches in response to unlatching of the first one. See, for example, U.S. Pat. Nos. 6,334,560 and 9,260,890.

Another common feature in latching systems of the type described above is a locking mechanism associated with one or both of the latches. Typically, a key cylinder is provided which, when unlocked by a key, causes one latch to open and allows a handle to move the operating rod such that the second latch is also unlatched. In some designs, a key cylinder may be positioned at both of the latches so that the enclosure may be unlocked at either latch.

One limitation of locking arrangements such as discussed above is that key cylinders are not particularly robust and may be defeated by one determined to gain entry into the enclosure. In the case of truck tool boxes, this can result in the theft of valuable tools and other equipment. No additional security measures are conventionally provided in truck tool boxes, and it is not practical for owners to remove and replace the contents of a box overnight, at a job site or other times when his or her vehicle is left unattended.

SUMMARY OF THE INVENTION

This invention is directed to a latch handle assembly for enclosures such as truck tool boxes which includes a latch handle that may be secured by a padlock to the front wall of the box, in addition to a key cylinder, to prevent movement of the latch handle, and, thus, opening of the box lid.

In one presently preferred embodiment, a truck box is provided with two spaced latches operative between the lid and front wall of the box. An operating rod is connected between the latches in such a way that when one of the latches is moved to an unlocked position the second latch is simultaneously unlatched. Actuation of the operating rod to unlatch the latches, in turn, occurs in response to first unlocking a key cylinder to position an operating rod actuator in alignment with an end of the operating rod. The latch handle, which is connected to the operating rod actuator, is then moved causing the operating rod to unlatch the first and second latches. In one embodiment, the latch handle is mounted at the front wall of the box by a face plate having a single shelf formed with one or more openings. The latch handle rests atop the shelf of the face plate in position such that a central key opening or one or more slots formed in the latch handle align with one of the openings in the shelf. The shackle of the padlock may be inserted through the aligning slot or central key opening in the latch handle, and an opening in the shelf, and then locked in the padlock body to secure the latch handle to the face plate. Regardless of whether or not the operating rod actuator is placed in alignment with the operating rod by the key cylinder, the operating rod is prevented from movement required to unlatch the latches when the padlock locks the latch handle to the face plate.

In an alternative embodiment, the face plate is formed with spaced top and bottom shelves each having at least one opening. The latch handle is located between the top and bottom shelves such that both its central key opening, and one or more slots, align with one of the openings in each of the top and bottom shelves. When unlocked, the shackle of a padlock may be inserted through the central key opening and an opening in one of the top and bottom shelves, or, alternatively, the shackle may be inserted through the elongated slot in the latch handle and into an opening in either one of the top or bottom shelves.

The latch handle assembly of this invention therefore provides an additional level of protection from unwanted entry into the truck tool box or other enclosure. Even if the key cylinder(s) is defeated, the lid of the box will not open because the latch handle, and, in turn, the operating rod, are prevented from movement by the padlock.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
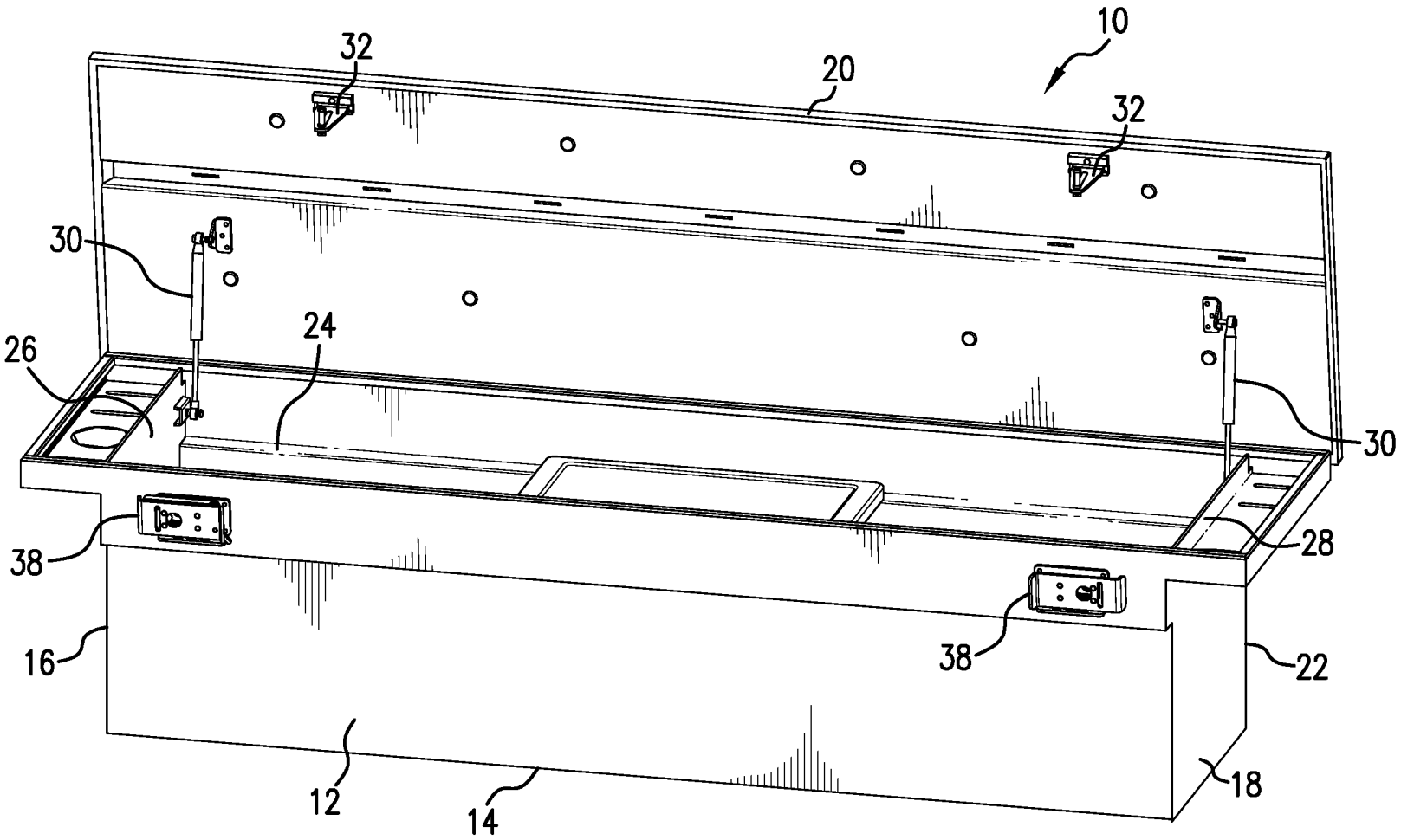
FIG. 1 is a perspective view of a truck box incorporating one embodiment of the latch handle assembly of this invention.

Referring initially to FIG. 1, a truck box 10 is shown which comprises a front wall 12, a bottom wall 14, opposed end walls 16, 18, a top wall or lid 20 and a back wall 22. Each of the walls 12-22 is preferably formed of aluminum tread plate and they are interconnected by welding to form a hollow interior 24. For purposes of illustration and the present discussion, a single lid, cross-over box is depicted in the FIG. 1 but it is contemplated that other types of truck boxes may be employed with the latch handle assembly of this invention, discussed below, including side-mount boxes, chest boxes, top mount boxes, trailer boxes, RV boxes and others.

The interior 24 of the truck box 10 may include a pair of plates 26, 28 located near respective end walls 16, 18. Each of the plates 26, 28 supports one end of a gas spring 30 which is mounted at its opposite end to the top wall 20. The top wall 20 also mounts a pair of spaced striker bars 32. Each striker bar 32 is positioned in alignment with a latch, such as a rotary latch (not shown), mounted to the front wall 12 of the box 10. The latches are commercially available items whose construction forms no part of this invention. Conventionally, the latches are connected to an operating rod 34 which is movable in a direction toward one or both of the end walls 16, 18. See FIGS. 4 and 5. In the course of such movement, the operating rod 34 is effective to move such latches from a latched position in which each of the latches receives and retains one of the striker bars 32, to an unlatched position wherein the latches release the striker bars 32 allowing the lid 20 to be opened. The construction and operation of conventional latches and an operating rod is disclosed, for example, in U.S. Pat. No. 6,334,560 the disclosure of which is hereby incorporated in its entirety herein.

Figure 2:
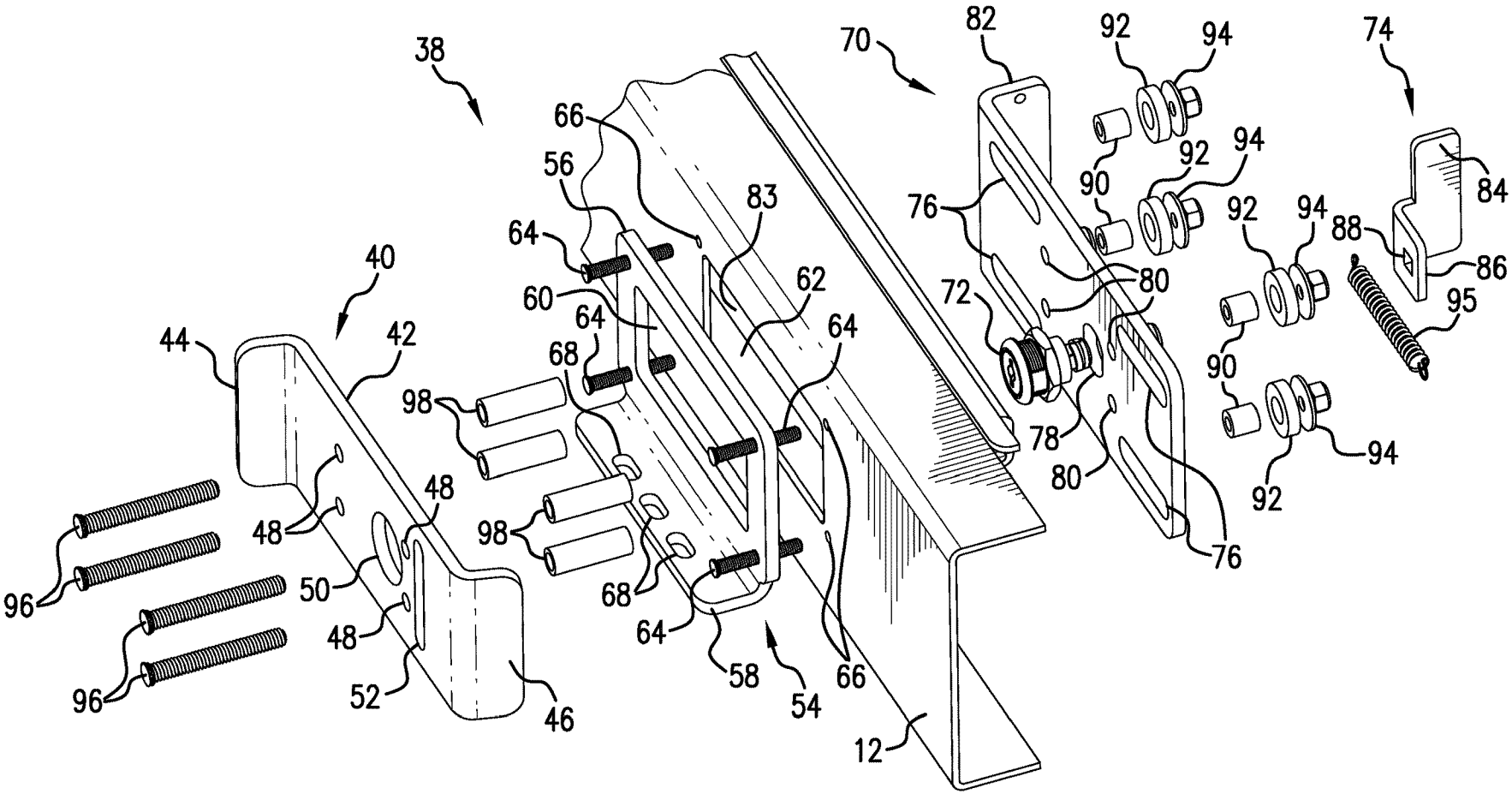
FIG. 2 is an exploded perspective view of the latch handle assembly of FIG. 1.

Referring now to FIG. 2, one embodiment of the lockable latch handle assembly 38 is illustrated. Each component of the assembly 38 is initially described separately below, followed by a discussion of how they are mounted to one another and operate.

The assembly 38 comprises a latch handle 40 having a center section 42 in between two end sections 44, 46 that are bent or otherwise formed in opposite directions at approximately a 90° angle relative to the center section 42. The end sections 44, 46 may be grasped by one's fingers to move the latch handle 40 toward one of the end walls 16, 18 of box 10. The center section 42 of latch handle 40 is formed with four holes 48, a key opening 50 in between the holes 48, and, an elongated, vertically oriented slot 52. For purposes of the present discussion, the terms "vertical," "horizontal," "top" and "bottom" refer to the orientation of the apparatus as depicted in the FIGS.

The lockable latch handle assembly 38 further comprises a face plate 54 having a vertically oriented wall 56 connected to or integrally formed with a horizontally disposed shelf 58. The wall 56 is formed with a generally rectangular-shaped window 60 which aligns with a similarly shaped opening 62 in the front wall 12 of the box 10. Four holes at each corner of the wall 56 each receive a fastener 64 for insertion through holes 66 in the front wall 12. The shelf 58 is preferably formed with spaced openings 68.

Within the interior 24 of the box 10, the assembly 38 includes a slide plate 70, a key cylinder 72 and an operating rod actuator 74. The slide plate 70 is formed with an elongated horizontally disposed slot 76 at each of its four corners, a central opening 78 and four holes 80. An end section 82 is connected to or integrally formed with the slide plate 70 which extends at an approximately 90° angle thereto. Preferably, a bushing seal plate 83 having an opening 85 is mounted to the inner surface of front wall 12 in contact with the slide plate 70 to facilitate movement of the slide plate 70, as discussed below. The opening 85 in bushing seal plate 83 aligns with the opening 62 in the front wall 12 of box 10. Additionally, the operating rod actuator 74 has an arm 84 and a mounting plate 86 formed with a bore 88.

Figure 4:
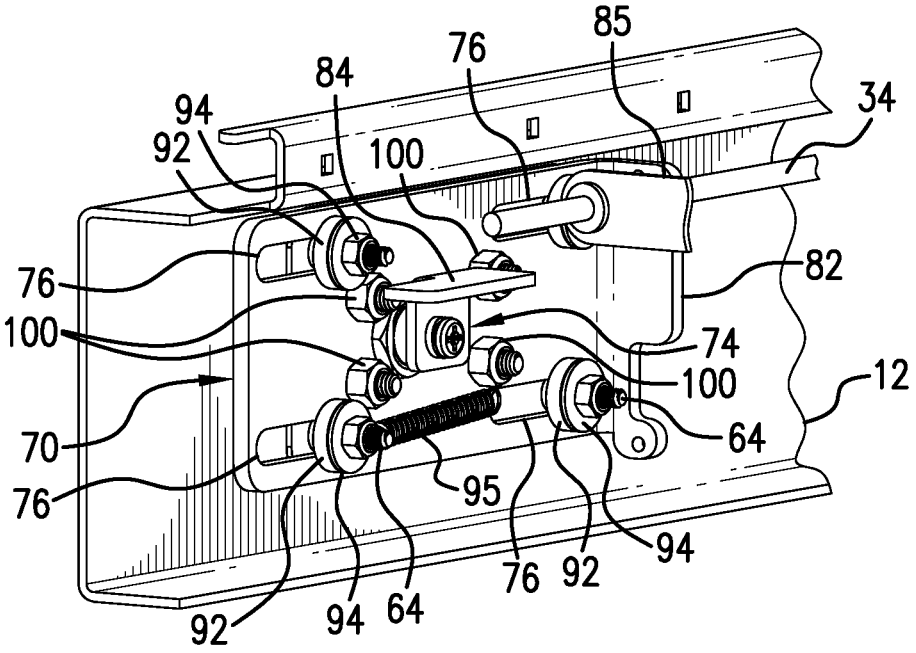
FIG. 4 is a rear perspective view of the latch handle assembly of FIG. 1 with an operating rod actuator in a bypass position.
Figure 5:
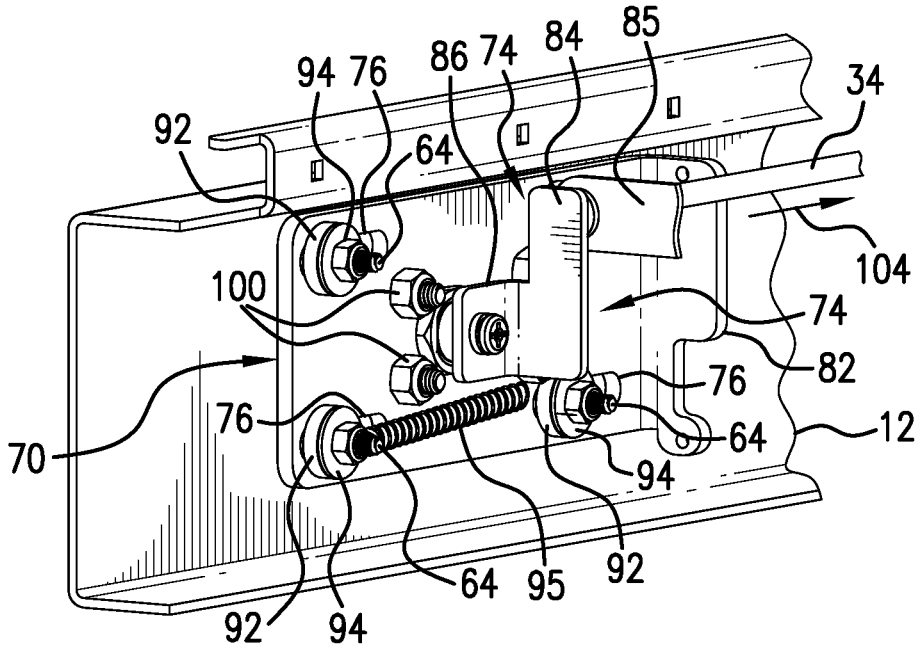
FIG. 5 is a view similar to FIG. 4 except with the operating rod actuator in a contact position aligned with an operating rod.

Referring now to FIGS. 2, 4 and 5, the lockable latch handle assembly 38 is assembled such that the latch handle 40 and slide plate 70 are movable as a unit, while the face plate 54 is fixed to the front wall 12 of the box 10. The wall 56 of face plate 54 is placed against the front wall 12 of box 10 such that the window 60 of wall 56 aligns with the opening 62 in front wall 12. In this position, each fastener 64 carried by the wall 56 may be inserted through one of the holes 66 in front wall 12 and then through respective slots 76 in the slide plate 70. An inner end of each fastener 64 receives a roller bushing 90, a washer 92 and a nut 94. The nuts 94 are tightened down on the fasteners 64 to secure the slide plate 70 for sliding movement along the bushing seal plate 83 relative to such fasteners 64. The key cylinder 72 is inserted through the central opening 78 in the slide plate 70 and its inner end extends through the hole 88 in the mounting plate 86 of the operating rod actuator 74 where it is secured in place. Additionally, as best seen in FIGS. 4 and 5, the end section 82 of slide plate 70 mounts a bracket 85 which connects to one end of the operating rod 34. A return spring 95 is connected at one end to a slot 76 at one side of the slide plate 70 and at its other end to a fastener 64 located opposite such slot 76.

The latch handle 40 is fixed to the slide plate 70 by four fasteners 96 each of which is inserted through a hole 48 in the center section of the latch handle 40, though a cylindrical-shaped spacer 98 and then through respective holes 80 in the slide plate 70. The ends of each fastener 96 receives a nut 100 (FIGS. 4 and 5) which are tightened down to fix the latch handle 40 to the slide plate 70. The spacers 98 are therefore captured between the latch handle 40 and slide plate 70 creating a space or stand-off between the latch handle 40 and the front wall 12 of box 10. The bottom of the latch handle 40 rests atop the shelf 58 of the face plate 54 in position such that the slot 52 and/or central bore 50 in latch handle 40 align with one of the openings in the shelf 58. Additionally, when mounted to the slide plate 70 the central opening 50 in the latch handle 40 aligns with the key cylinder 72.

It can be appreciated from the foregoing description that movement of the latch handle 40 in a direction toward one of the end walls 16, 18 of box 10 carries with it the slide plate 70. The slide plate 70 is fixed to the latch handle 40 and it slides along roller bushings 90 located within slots 76 relative to the fasteners 64 extending from the face plate 54. In turn, since the key cylinder 72 is connected to the slide plate 70, and the actuator 74 is mounted to the key cylinder 72, they too move with the latch handle 40 and slide plate 70.

The lockable latch assembly 38 of this invention illustrated in FIGS. 1-5 operates as follows. As noted above, the operating rod 34 is adapted to move the latches from a latched position to an unlatched position. In order to effect movement of the operating rod 34, the key cylinder 72 must rotate the actuator arm 84 of the actuator 74 from a bypass position depicted in FIG. 4 to a contact position shown in FIG. 5. In the contact position, the arm 84 is vertically upright and aligns with an end of the operating rod 34, whereas in the bypass position the arm 84 is horizontally oriented and out of alignment with the operating rod 34. Access to the key cylinder 72 is permitted by inserting a key (not shown) through the key opening 50 in the latch handle 40 and into the key cylinder 72. When rotated to the contact position by the key cylinder 72, the arm 84 of the actuator 74 may engage the operating rod 34. Because the actuator 74 is connected to the latch handle 40 via slide plate 70, and with its arm 84 in the contact position, movement of the latch handle 40 from a first position depicted in FIG. 4 in the direction of arrow 104 to a second position shown in FIG. 5 causes the arm 34 to engage and move operating rod 34 to unlatch the latches as described in U.S. Pat. No. 6,334,560 referenced above. The latch handle 40 may be moved to the second position by grasping one or both of its end sections 44, 46 and sliding it in the direction of arrow 104. After releasing the latch handle 40, it is moved back the first position, in the opposite direction of arrow 104, under the influence of the spring force exerted by return spring 95.

Figure 3:
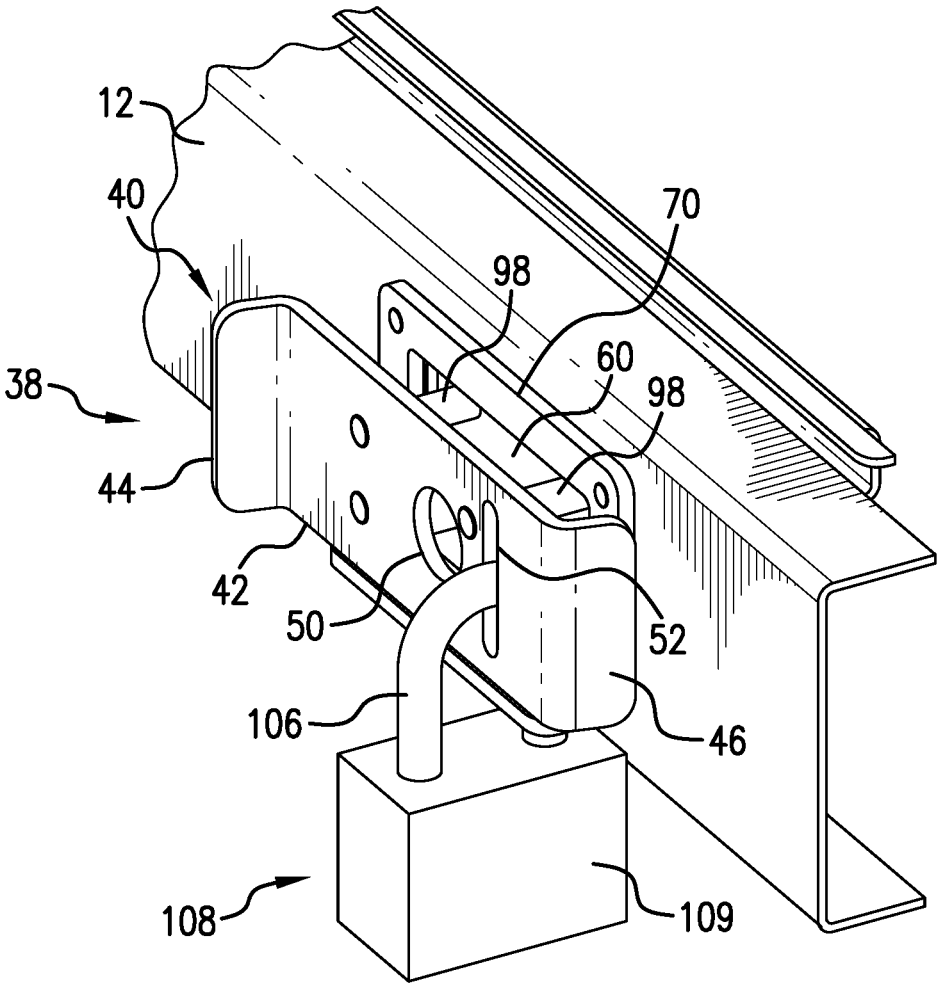
FIG. 3 is an enlarged perspective view of a latch handle of FIG. 1 with a padlock locking it in place on a face plate which is fixed to the front wall of the box.

An important aspect of this invention is the provision of a locking feature in addition to that afforded by key cylinder 72. As best seen in FIGS. 2 and 3, the latch handle 40 may be located relative to the face plate 54 such that its key opening 50 and/or slot 52 align with one of the openings 68 in the shelf 58 of the face plate 54. In this position, the shackle 106 of a padlock 108 may be inserted through the key opening 50 or through the slot 54, into an opening 68 of shelf 58 and then locked into the body 109 of the padlock 108. This prevents the latch handle 40 from side-to-side motion since the face plate 54 is fixed to the front wall 12 of box 10. Accordingly, even if the key cylinder 72 has moved the arm 84 of actuator 74 to the contact position, either by operation of a key or as a result of an attempt to defeat the key cylinder 72, the latch handle 40 is prevented by the padlock 108 from moving the arm 84, and, in turn, the operating rod 34. Moreover, if the shackle 106 is inserted through the key opening 50 of latch handle 40 into an opening 68 for locking, instead of through slot 52, access with a key to the key cylinder 72 through such key opening 50 is blocked by the shackle 106. This locking feature of the invention provides added protection against unwanted intrusion into the box 10 where valuable tools and other items may be stored.

Figure 6:
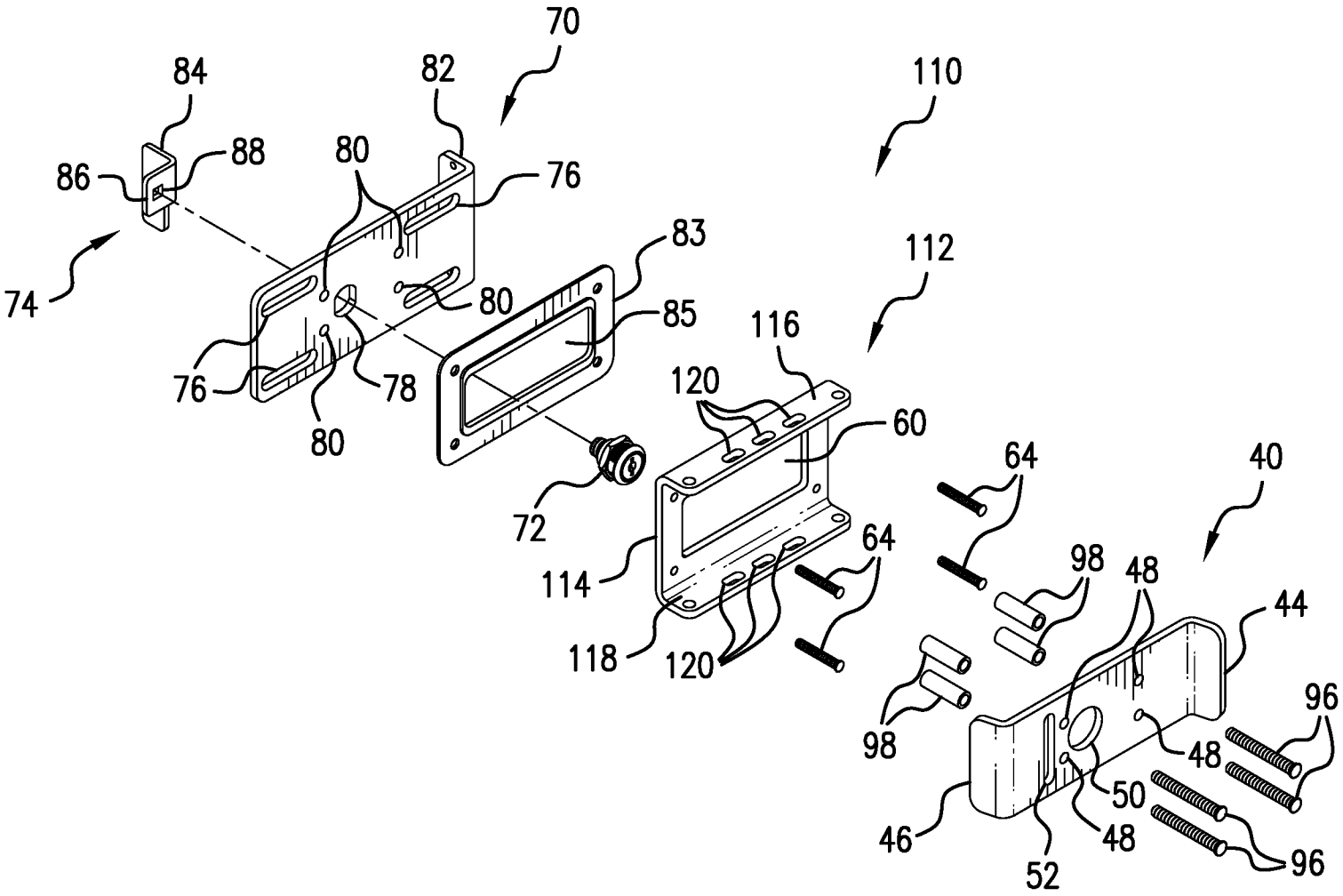
FIG. 6 is a view similar to FIG. 2 except illustrating a latch handle assembly having an alternative embodiment of a face plate according to this invention and a portion of the remaining structure depicted in FIG. 2.
Figure 7:
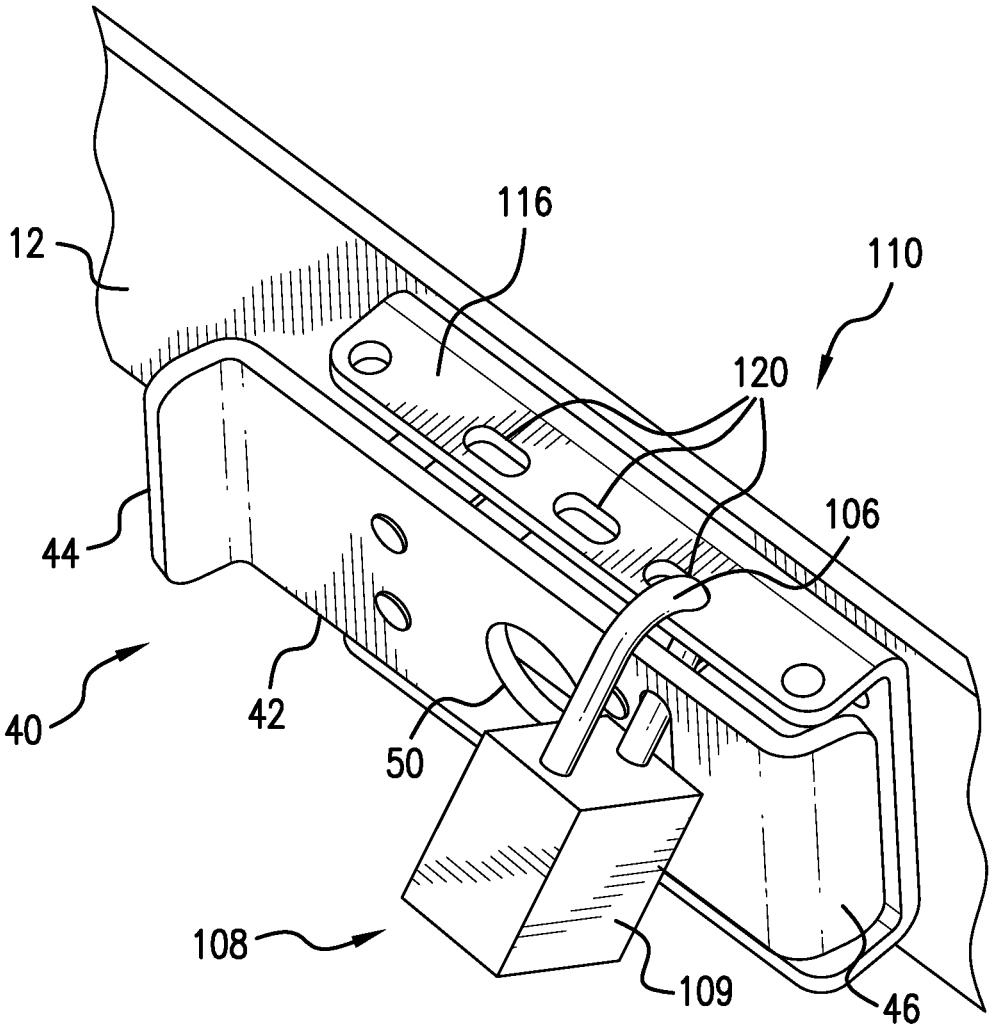
FIG. 7 is a view similar to FIG. 3 but with a padlock connected between the latch handle and a top shelf of the face plate shown in the embodiment of FIG. 6.

Referring now to FIGS. 6 and 7, and alternative embodiment of a lockable latch handle assembly 110 is illustrated. All of the reference numbers discussed above in connection with the embodiment of FIGS. 1-5 identify common structure to that shown in this embodiment.

As seen in FIG. 6, the assembly 110 includes a face plate 112 having a vertical wall 114 connected to or integrally formed with a horizontally disposed top shelf 116 and bottom shelf 118 which are spaced from one another. Each of the top and bottom shelves 116, 118 are formed with a number of spaced openings 120. The vertical wall 114 is formed with a generally rectangular-shaped window 60 which aligns with a similarly shaped opening 62 in the front wall 12 of the box 10. Four holes at each corner of the vertical wall 114 each receive a fastener 64 for insertion through holes 66 in the front wall 12 to secure the face plate 112 to front wall 12. The latch handle 40, face plate 112, seal plate 83, slide plate 70, rod actuator 74 and key cylinder 72 of assembly 110 are assembled in the same manner as discussed in connection with the embodiment of FIGS. 1-5. However, as best seen in FIG. 7, the latch handle 40 is located between the top and bottom shelves 116, 118 instead of resting atop the shelf 58 of face plate 54 as illustrated in FIG. 3.

The assembly 110 of this embodiment is constructed and operates in the same manner as assembly 38 discussed above except for optional positioning of the padlock 108 relative to the latch handle 40 and face plate 112 provided by the top and bottom shelves 116, 118. The latch handle 40 may be located relative to the face plate 112 such that its key opening 50 and/or slot 52 align with one of the openings 120 in either the top shelf 116 or bottom shelf 118 of face plate 112. In this position, the shackle 106 of a padlock 108 may be inserted through the key opening 50 or slot 54 into an opening 120 of the top shelf 116 (FIG. 7), or into an opening 120 in the bottom shelf 118 as in FIG. 5, and then locked into the body 109 of the padlock 108. It has been found that in some applications the padlock 108 may be prevented from locking, or it is difficult to do so, if only a bottom shelf 58 of a face plate 54 is provided as depicted in FIGS. 2 and 3.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus, comprising:

an enclosure having walls interconnected to form an interior and a lid movable between open and closed positions relative to said interior;

an operating rod adapted to move at least one latch to an unlatched position, said at least one latch being adapted to be mounted to one of said lid and a wall of said enclosure;

a latch handle assembly, comprising:

(i) a latch handle movable between a first position and a second position, said latch handle being formed with at least one slot;

(ii) an actuator connected to said latch handle, said actuator being movable to a contact position in alignment with said operating rod, said actuator when in said contact position being movable with said latch handle from said first position to said second position wherein said actuator causes said operating rod to move the at least one latch to the unlatched position;

(iii) a face plate mounted to said wall of said enclosure, said face plate being formed with a top shelf and a bottom shelf spaced from one another to receive said latch handle between them, each of the top and bottom shelves being formed with at least one opening;

(iv) a key cylinder connected to said actuator, said actuator being formed with an arm, said key cylinder being effective to move said actuator between a locked position wherein said arm is out of alignment with said operating rod and an unlocked position wherein said arm aligns with said operating rod; and (v) a padlock having a shackle and a padlock body, said shackle being insertable, when in an unlocked position, through said at least one slot in said latch handle and into said at least one opening in one of said top and bottom shelves of said face plate, said shackle being movable to a locked position within said padlock body to secure said latch handle to said face plate and thereby prevent said latch handle from moving from said first position to said second position.

2. The apparatus of claim 1 in which said shackle is insertable through said at least one slot in said latch handle and into said at least one opening in said top shelf of said face plate.

3. The apparatus of claim 1 in which said shackle is insertable through said at least one slot in said latch handle and into said at least one opening in said bottom shelf of said face plate.

4. The apparatus of claim 1 in which said latch handle is formed with a key opening, said shackle being insertable through said key opening in said latch handle and into said at least one opening in said top shelf of said face plate.

5. The apparatus of claim 1 in which said shackle is insertable through a key opening in said latch handle and into said at least one opening in said bottom shelf of said face plate.

6. The apparatus of claim 1 in which said padlock, when said shackle is in said locked position within said padlock body, is effective to prevent said latch handle from moving to said second position regardless of whether said key cylinder has moved said actuator to an unlocked position.

* * * * *